United States Patent [19]

Worth

[11] Patent Number: 4,537,458

[45] Date of Patent: Aug. 27, 1985

[54] CONDUCTIVE SHIELDING HOUSING FOR FLAT CABLE CONNECTOR

[75] Inventor: Sidney V. Worth, Flourtown, Pa.

[73] Assignee: Continental-Wirt Electronics Corp., Southampton, Pa.

[21] Appl. No.: 528,624

[22] Filed: Sep. 1, 1983

[51] Int. Cl.[3] ..... H01R 13/698

[52] U.S. Cl. ..... 339/143 R; 339/17 F

[58] Field of Search ..... 339/17 F, 143 R, 176 MF, 339/14 R, 89 R

[56] References Cited

U.S. PATENT DOCUMENTS

| | | | |
|---|---|---|---|
| 3,744,128 | 7/1973 | Fisher et al. | 339/143 R X |
| 3,830,957 | 8/1979 | Oberdiear | 339/89 R X |
| 4,337,989 | 7/1982 | Asick et al. | 339/143 R |
| 4,457,575 | 7/1984 | Davis et al. | 339/143 R |

*Primary Examiner*—Eugene F. Desmond

*Attorney, Agent, or Firm*—Ostrolenk, Faber, Gerb & Soffen

[57] ABSTRACT

A flat cable connector which receives a flat cable having a conductive sheath is completely enclosed in a metallic casing which electrostatically and electromagnetically shields the electrical conductors within the connector. The casing is formed of stamped metal parts including two end cups and two side plates which are clamped over the edges of the end cups. The side plates have inwardly turned serrated sections which bite into and securely clamp the flat cable as it extends out of the flat cable connector housing. The side plate bottoms hook into slots in the bottoms of the end cups. The tops of the side plates have projections which latch into openings in the tops of the end cups to hold the housing together. In another embodiment, bifurcated clamping pins having tapered legs enter aligned slots on the side plates and end cups in order to hold them together. The flat cable follows a serpentine path within the conductive enclosure and its conductive sheath is pressed into engagement with the interior of the side plates. In other embodiments, a compressible conductive gasket which may be a conductive wire mesh gasket or the bunched-up foil of the cable itself surrounds the flat cable conductor within the metal housing and is compressed into engagement with the interior surfaces of the enclosing metal housing. A metal shroud surrounds the connector bottom and is connected to the side plates and end cups. The distance by which the shroud telescopes into the side plates and end cups is controlled by detents in the side plates.

22 Claims, 15 Drawing Figures

CONDUCTIVE SHIELDING HOUSING FOR FLAT CABLE CONNECTOR

BACKGROUND OF THE INVENTION

This invention relates to a shielding structure for electrical conductors and more specifically relates to a novel shield for insulation displacement connectors.

Electrical connectors which make connection to a plurality of individual conductors contained in a flat cable are well known. A connector which is typical of this variety of device is shown in copending application Ser. No. 951,629, filed Oct. 16, 1978 in the name of Sidney V. Worth, entitled "Connector Structure for Flat Cable" and is assigned to the assignee of the present invention. Such connectors are frequently used with equipment which is sensitive to stray electrostatic and electromagnetic radiation such as computer and computer peripheral equipment.

Emission of electrostatic and electromagnetic waves can take place from conductors transferring impulses from one piece of equipment to another or from one computer to another. Accordingly, the conductors including the connectors which are attached to the conductors and which carry the electrical impulses from one device to another must be shielded from electrostatic and electromagnetic emissions.

It is, therefore, desirable to provide a shielding housing for displacement connectors to shield the interior contacts and conductors to prevent the generation therefrom of electrostatic or electromagnetic radiation and to prevent such stray fields from reaching into the interior of the connector.

Metal housings have been provided in the past for multi-conductor connectors. These housings, however, employ expensive metals and complex shapes which are difficult to manufacture in order to shroud the connector. Moreover, the shrouding metal used in the past has been fixed to the connector by screw connections or other relatively permanent connections which make it difficult to gain access to the connector when necessary.

BRIEF DESCRIPTION OF THE INVENTION

In accordance with the invention, a novel conductive sheath is provided for flat cable connectors which make connections to flat cable which has a conductive outer sheath. The conductive housing consists of inexpensive stamped metal parts which are simply clamped together to enclose the connector and the flat cable extending from one end thereof.

The conductive sheath of the flat cable is exposed in the interior of the conductive housing and is looped to force it into contact with the conductive housing. Alternatively, a conductive compressible gasket is disposed within the conductive housing and surrounds and is compressed into contact with the conductive sheath of the flat cable at the region where it enters the connector. The conductive gasket can take any desired form and can, for example, consist of a wire woven gasket or could consist of a gasket made of the conductive outer sheath foil which is removed from the cable. This foil can remain connected to the main sheath body and can be "bunched-up" to be readily compressible. Alternatively, conductive foil can be wrapped around the cable to form a compressible gasket strip of D-ring shape. The exterior of the conductive gasket is compressed into contact with the interior surface of the surrounding conductive casing. In each of the embodiments, the connection between the cable foil and housing interior is compressible to permit large manufacturing tolerances for the housing and for the cable while ensuring adequate electrical contact between the cable and the conductive housing. Thus, inexpensive stamped metal parts can be used for the housing.

The side plates of the casing are provided with inwardly projecting edges which are serrated and which are clamped into contact with the opposing surfaces of the cable. This provides strain relief for the cable. The bottom of at least one of the side plates is pivotally hooked beneath end cups at either end of the housing so that the sides can pivot to an enclosing position. The tops of the side plates have latch hooks which can enter cooperating slots in the top of the end cups to complete the enclosure. Securement keys can also be used. The enclosure can also include a metal shroud for shrouding the connector base to improve field isolation by shielding the contact pin region of the connector. The metal shroud telescopes into the side plates and end cups by a desired distance, as determined by detents in the side plates. The shroud is fixed in position when the side plates are latched onto the end cups.

The novel housing structure is applicable to any type of connector and particularly to sub-miniature D-type connectors. The assemblage is put together without the need for screws and employs all stamped metal parts. Moreover, the conductively sheathed connector can be mated with a cooperating connector or can be connected to a panel mount arrangement.

Various types of connections can be made to the cable while maintaining the shielding enclosure around the interior connector contacts. For example, the end of the cable can terminate on the connector in the usual fashion. Alternatively, a central portion of the length of a cable can be connected to the connector contacts to enable "daisy-chain" connections to an elongated cable while maintaining good EMI suppression.

DETAILED DESCRIPTION OF THE DRAWINGS

Figure 1:
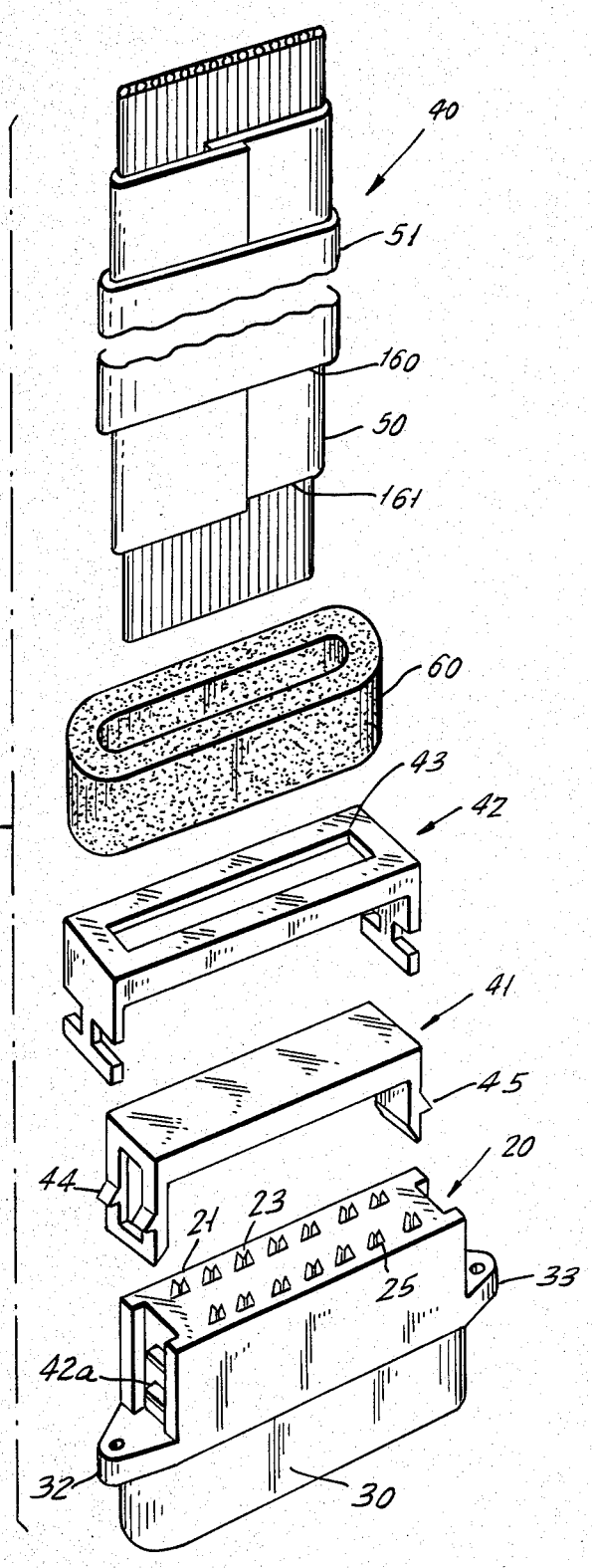
FIG. 1 is an exploded perspective view of a conventional insulation displacement connector along with a shielded flat cable and the novel conductive gasket of the invention shown as a wire woven gasket.

The drawings illustrate different embodiments of the novel invention for shielding an insulation displacement connector 20. The connector 20 is a well-known device and can, for example, have the construction disclosed in above-noted copending application Ser. No. 951,629. filed Oct. 16, 1978 in the name of Sidney V. Worth, entitled "Connector Structure for Flat Cable". Connector 20 shown in FIG. 1 conventionally has a plurality of symmetrically spaced, respectively insulated contacts, shown as contacts 21, 23 and 25. In FIG. 1, the cable piercing ends of the contacts are shown. These piercing ends are capable of piercing the insulation sheath of a flat multi-conductor cable in order to connect respective ones of the contacts of the connector to a respective one of the wires of the cable. By way of example, connector 20 of FIG. 1 could have 25 contacts for making engagement with 25 conductors of a flat cable. Any other desired number could also be used.

Figure 3:
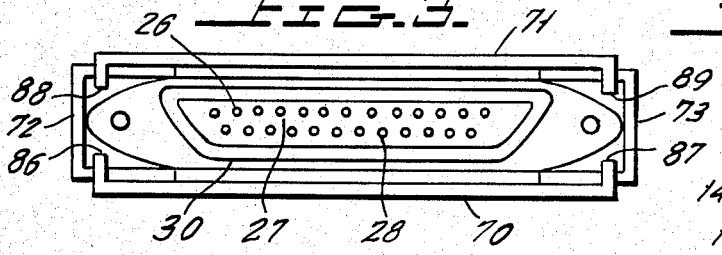
FIG. 3 is a bottom view of the assembled shielded housing of FIG. 2.

The piercing ends of contacts 21, 23 and 25 are spaced from one another by the spacing of the conductors of the flat cable. The other end of each contact is shaped to terminate in a plug-in type contact pin such as the contact pins 26, 27 and 28 which are visible in the bottom view of FIG. 3. The pins such as the pins 26 to 28 can have any desired spacing and are operable to plug into a suitable socket or pin-type contact.

In the embodiment of FIGS. 1 to 8, a generally D-shaped insulation shroud 30 encloses the contact pins such as pins 26 to 28 in the usual manner. The housing 20 is also provided with mounting flanges 32 and 33 which have respective openings therethrough for receiving mounting hardware.

FIG. 1 also shows a typical multi-cable conductor 40 which can, for example, contain 25 parallel conductors which are insulated from one another within a pliable molded insulation material. Conventional tools are available for pressing a flat side of cable 40 over the various projecting contacts 21 to 25 of connector 20 so that the contacts pierce the insulation and engage respective conductors of the cable 40.

In order to hold the cable in place with the cable conductors impaled by the respective contact piercing ends, it is common to provide a cover 41 which snaps over the connector 20 and is latched to connector 20 by engaging latch projection 42*a* and a similar projection on the other side of the connector 20 (not shown in FIG. 1). The underside of cover 41 will then press down on the portion of cable 40 which is pierced by the various contact piercing ends. A still further cover 42 can be applied over the cover 41 to provide strain relief for the cable 40. Thus, cover 42 may receive the cable 40 through its central slot 43 and the cover legs are latched onto latches 44 and 45 on the outside of the legs of cover 41. Note that the cover can come out through the side of the shroud if desired. The cable which comes from the underside of cover 41 is looped over the top of cover 41 and through the center of cover 42 so that forces applied to the cable will not pull the cable away from contacts 21 to 25.

When the cable 40 is to be shielded against electrostatic and electromagnetic emission, the cable is commonly covered with a thin conductive foil or sheath 60, which can be of aluminum or any other desired conductive material, and the foil-covered cable is then encased in a relatively thick plastic sheath 51. It has, however, been difficult in the past to continue the conductive sheath 50 into the connector to ensure against electrostatic and electromagnetic emissions from the conductors and contacts within the connector region.

In accordance with the present invention, a novel sheet metal housing is formed around the connector 20 and its covers in such a manner as to effectively and inexpensively sheath the connector with a conductive housing which is continuous with the metal sheath 50 of the cable 40.

Figure 2:
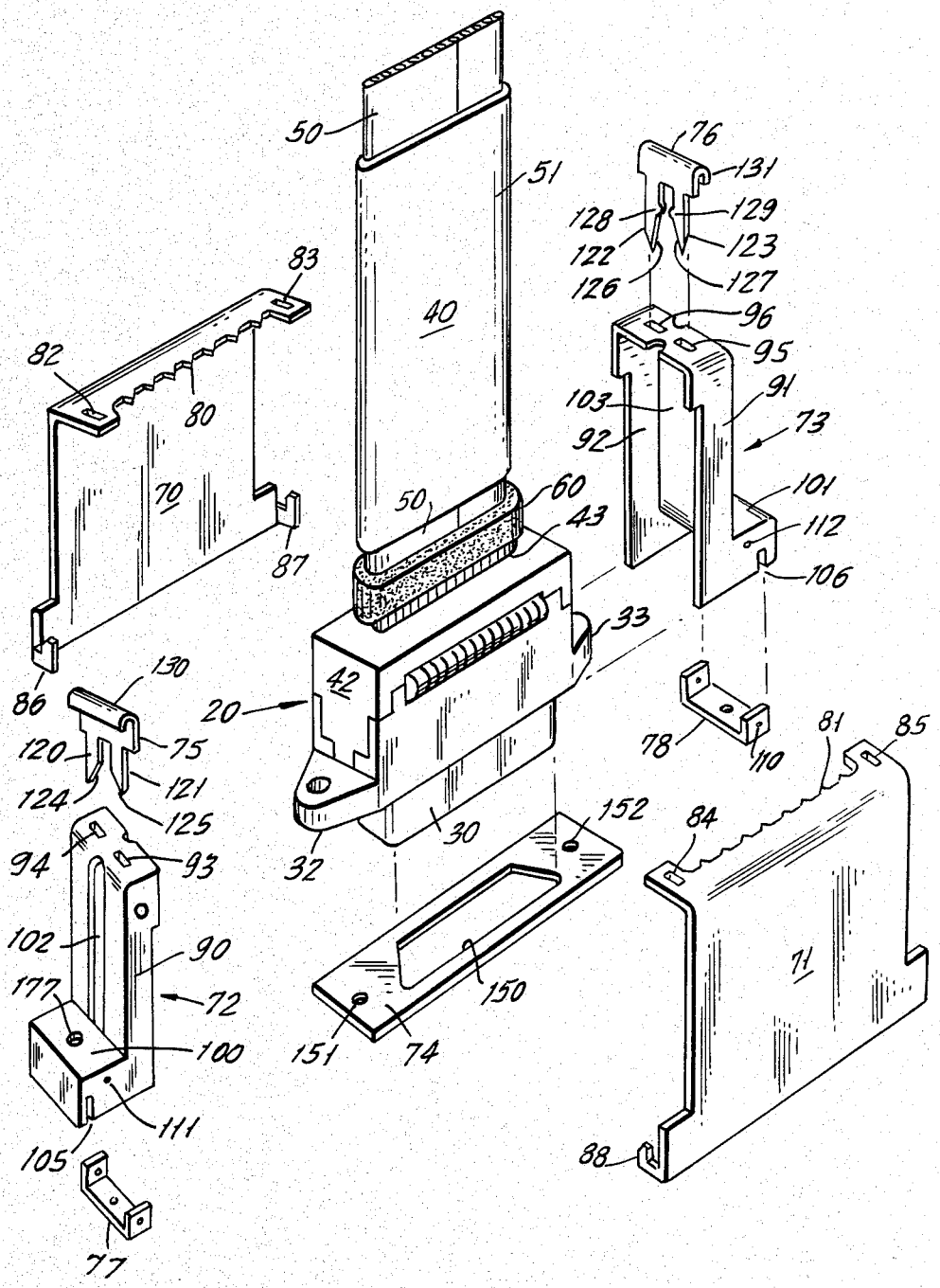
FIG. 2 is an exploded perspective view of the conductive housing for enclosing the assembled connector of FIG. 1.
Figure 6:
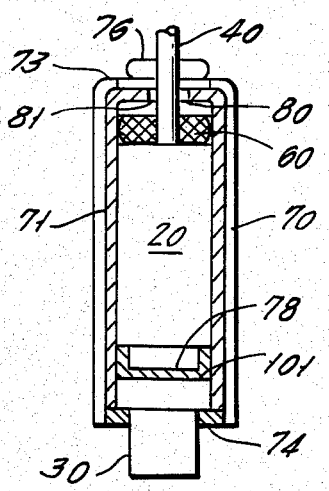
FIG. 6 is a partially schematic cross-sectional view of the housing of FIG. 4, showing the relationship of the various components of the conductive housing.
Figure 8:
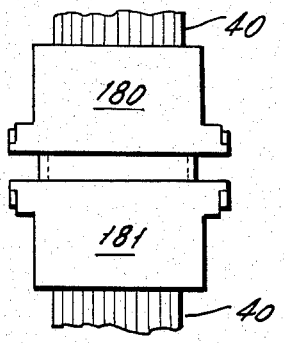
FIG. 8 illustrates two shielded insulation displacement connectors, both provided with the housing of the invention and connected together in a so-called flying connection.

In a first embodiment of the invention, described in FIGS. 1 to 8, a conductive gasket or compressible wire woven mesh gasket 60 is employed (FIGS. 1, 2 and 6). The gasket, however, can be of any form which is compressible and, for example, could consist of the bunched-up foil stripped from the end of the cable or wrapped around the cable. The conductive gasket 60 can be a continuous ring, as shown, or can be an elongated sheath of material bent to a partial or complete ring shape. Gasket 60 is electrically connected to and is compressed between the sheath 50 of cable 40 and the interior surfaces of the enclosing stamped metal enclosure to be described. Its dimensions are such that it will be squeezed or compressed during the assembly of the housing to ensure effective electrical continuity between the exposed shielding foil 50 of the cable and the interior sides of the enclosing conductive housing.

The housing structure shown in FIG. 2 consists of side plates 70 and 71 which are of identical construction and end cups 72 and 73 which are also of identical construction. As will be later described, plate 70 and end cups 72 and 73 can be a unitary structure. A front conductive gasket 74 may also provided for enclosing the bottom of the conductor. The side plates 70 and 71 and end cups 72 and 73 are held together in the embodiment of FIGS. 1 to 8 by bifurcated keys 75 and 76 which are fit into slots to be described in order to releasably hold the side plates and end cups firmly in position. Other latching means will be described in the embodiment of FIGS. 9 to 14. Two U-shaped, inverted spaces 77 (FIG. 2) and 78 (FIGS. 2 and 6), are also provided to space appropriately bottom surfaces of end cups 72 and 73 from the tops of insulation flanges 32 and 33 of the displacement connector 20.

Side plates 70 and 71 are provided with upper, inwardly turned flaps or edges 80 and 81, respectively, which are both serrated as shown in FIGS. 2 and 6. The edges 80 and 81 are further provided with slots 82–83 and 84–85, respectively, in the embodiment of FIGS. 1 to 8. The bottoms of the side plates 71 are formed, as shown in FIG. 2, with inwardly turned hook portions 86–87 for side plate 70, and hook portion 88 and another (not shown) for the side plate 71. Side plates 70 and 71 are thin metal stampings which may be steel and are bent to the shape shown after the stamping operation is completed. Note that the members 70, 71, 72 and 73 extend above the end of connector 20 and define a hollow region above the end of connector 20 and surrounding cable 40, which hollow region receives gasket 60.

End cups 72 and 73 are of identical construction and may also be stamped from the same thin steel as the side plates 70 and 71. End cups 72 and 73 consist of thin side walls such as the side wall 90 shown for cup 72 in FIG. 2 and the similar side walls 91 and 92 for end cup 73.

The end cups of FIGS. 1 to 8 are integrally joined at top sections containing slots 93 and 94 for cup 72 and slots 95 and 96 for cup 73. Slots 93, 94, 95 and 96 have the same shape as and cooperate with slots 84, 82, 85 and 83, respectively, in the side plates 71 and 70.

Figure 4:
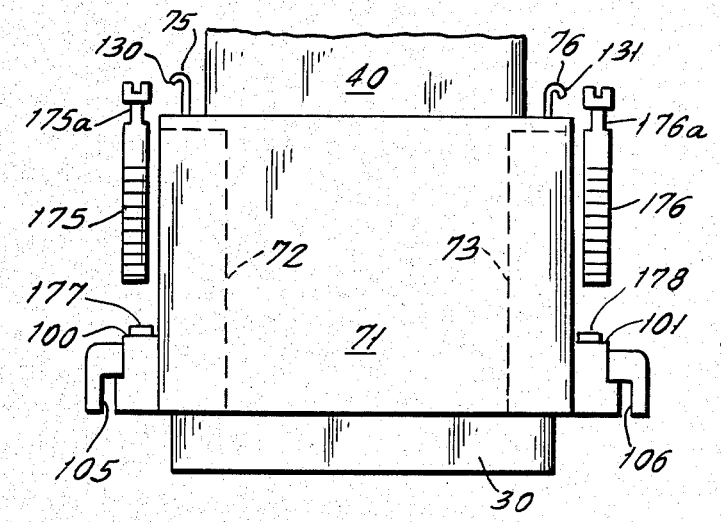
FIG. 4 is an elevation view of the assembled housing of FIG. 2.
Figure 5:
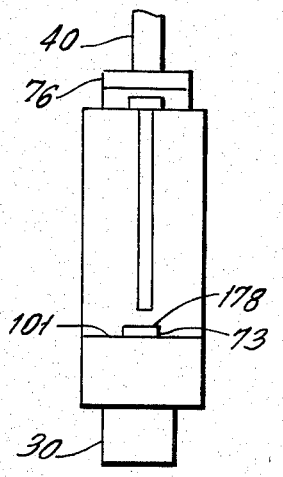
FIG. 5 is a side view of FIG. 4.

Cups 72 and 73 are further provided with integral base shelf regions 100 and 101 (FIGS. 2, 4 and 6) which join with integral end walls 102 and 103, the sides of which are integral with the sides of the end cups. As shown in FIGS. 2 and 4, hook receiving slots such as the hook-receiving slot 105 for cup 72 and 106 in cup 73 are provided beneath the platforms 100 and 101 and are symmetrically provided on either side of each end cup. These hook-receiving slots, such as slots 105 and 106, receive the hooks 86, 87, 88 and another similar to hook 88 for the side plates 70 and 71, as will be later described.

U-shaped spacers 77 and 78, which may be either the same stamped material as the structure described to this point or a thinner material, if desired, which may be of the same or a different composition than the end cups or side plates, are inserted to fit beneath the platforms 100 and 101, as is best shown in FIG. 6 for the case of spacer 78. Note that the legs of spacers 77 and 78 can have projections such as the bump 110 in spacer 78 in FIG. 2, which will seat in holes in the sides of the end plates such as holes 111 and 112 in end cups 72 and 73, respectively.

In the embodiment of FIGS. 1 to 8, locking keys 75 and 76 are of identical construction and are bifurcated members having spaced legs 120–121 and 122–123, respectively, which have opposing camming tapers 124 to 127, respectively. The upper ends of tapers 124 to 127 can terminate at extending locking bumps, such as the locking bumps 128 and 129 shown for the locking key 76. Each of the locking keys is further provided with outwardly bent projection edges 130 and 131, respectively, which provide a means for easily gripping the key with a tool in order to remove the key from a locking engagement, as will be later described.

Figure 7:
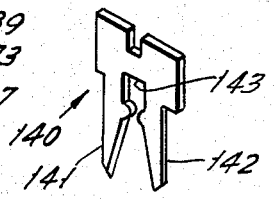
FIG. 7 is a perspective view of a modified clamping key which could be used to clamp the conductive housing parts together.

The locking keys 75 and 76 can take any desired shape and could have the shape shown, for example, in perspective view in FIG. 7 for the key 140. Key 140 is a flat metal stamping having legs 141 and 142 which are cam shaped and have the same general configuration as the legs of the keys 75 and 76. In FIG. 7, however, the legs extend to a raised region 143 which will be exposed for access to a prying tool when the key is in clamping position. Keys 75 and 76 may be permanently magnetized so that they will cling to the steel side plates 70 and 71 are to avoid their loss.

The front conductive gasket 74 has a central opening 150 which generally takes the shape of the D-shaped shroud 30 of the connector 20. Two openings 151 and 152 are also provided for receiving screw-type fasteners which may extend through the aligned openings in flanges 32 and 33 of the connector 20 in order to mount the connector 20. Gasket 74 may be also a stamped metal member made of the same material as is used for the other parts of the conductive enclosure.

The manner in which the cable 40 is prepared and the enclosure is connected around the connector 20 is now described. Referring to FIG. 1, the shielded cable 40 is first prepared by stripping the outer insulation cable jacket 51 from the cable for a distance of about 1 or 2 inches from the cable end. Thus, the jacket 51 terminates at end 160 in FIG. 1. A portion of the conductive foil 50 is then removed from the end of the cable 40 and terminates at end 161, exposing approximately 1 inch of the unsheathed multiconductor cable. As pointed out above, this length of foil may simply be forced up from the end of the cable and bunched to form the gasket 60. Alternatively, the length of foil can be wrapped around the cable to form the gasket 60.

In the embodiment illustrated in FIGS. 1 to 8, the end of cable 40 is threaded through the woven wire O-ring gasket 60. The gasket 60 is then moved up and over the conductive foil 50. The cable is further threaded through opening 43 in cover 42.

The cable is then conventionally connected to the various contacts at contact piercing ends 21, 23 and 25 of connector 20. Cover 40 is then applied over the connection and strain relief cover 43 is forced over the cover 41 and onto connector 20. The connector 20 and cable 40 will then have the appearance shown in FIG. 2.

Thereafter, the conductive housing is assembled around the connected cable 40 and connector 20. To accomplish this, the end cups 72 and 73 are first fitted over respective opposite sides of connector 20 with the spacers 77 and 78 seating against the tops of the flanges 32 and 33, as shown, for example, in FIG. 6. The side plates 70 and 71 are then assembled by first hooking the hooks 86 and 87 into their cooperating slots in end cups 72 and 73 (not shown in FIG. 2) and hooking the hook 88 and another of side plate 71 (not shown in FIG. 2) into slots 105 and 106, respectively. The side plates 70 and 71 are then pressed over the outer surface of end cups 72 and 73 until slots 82, 84, 83 and 85 overlie and align with slots 94, 93, 96 and 95, respectively, in end cups 72 and 73.

During this assembly, the woven wire O-ring or gasket 60, which has a large diameter, is compressed against the interior surfaces of end cups 72 and 73 in side plates 70 and 71. Thus, electrical connection is made from the conductive sheath 50 of cable 40 to the conductive housing being assembled over the connector 20. Since gasket 60 is highly compressible, this connection is made even though there is a large manufacturing tolerance for the dimensions of the stamped metal parts. The same result occurs if the conductive sheath 50 is bunched, or if an extension of the sheath is around the cable within the housing.

Thereafter, key 75 is applied so that its legs 120 and 121 enter aligned slots 82–94 and 84–93 respectively. Similarly, key 76 is applied so that its legs 122 and 123 enter aligned slots 96–83 and 95–85, respectively. During this insertion operation, the slots may be aligned simply by pressing the side plates 70 and 71 together by hand. However, the camming surfaces of the legs 120 to 123 of keys 75 and 76 will force the end cups and side plates into final firm and relatively permanent engagement with one another, while causing the teeth of the side plates to bite into and firmly grasp the outer cable jacket.

Key 76 is inserted until its locking bumps, such as locking bumps 128 and 129, fit under the bottoms of slots 96 and 95, respectively to latch the key 76 in position. Similarly, the locking bumps of key 75 will latch under the bottoms of slots 94 and 93, respectively when the key 75 is fully inserted. Note that keys having the structure of key 140 shown in FIG. 7 could have been used in place of the keys 75 and 76.

At this time the conductive housing is firmly assembled in place over the connector 20 and all internal conductors and contacts of the connector are well shielded against electrostatic and electromagnetic radiation. In order to also shield the bottom of the connector, the front conductive gasket 74 may be fixed in place over the bottom of the connector 20, as shown in FIG. 6. The completely housed device then has the configuration shown, for example, in FIGS. 4 and 5.

In order to open the conductive housing to gain access to the connector 20, it is only necessary to pry the keys 75 and 76 away from their locked position by inserting a suitable tool beneath projections 130 and 131 and removing the keys. With the removal of the two keys, the entire conductive housing is easily opened.

The completely shielded assembly can then be used for connection in any desired and usual manner normally used for insulation displacement connectors. By way of example, the connector can be conventionally connected to the contacts contained on a panel. When the devices are to be connected to a panel or to another connector, appropriate connection screws, such as screws 175 and 176, can be used, as shown in FIG. 4. These screws will pass through threaded openings 177 and 178 in end cups 72 and 73, respectively, the corresponding openings in flanges 32 and 33 respectively of the D connector 20 and corresponding openings 151 and 152 respectively in the front conductive gasket 74. Screws 175 and 176 have reduced diameter shoulders **175*a* and 176*a* which prevent further advance of the screws 175 and 176 when the shoulders reach the threaded openings 177 and 178**, while the screws are held loosely in place and are available for use in making connection to another connector or panel.

Alternatively, a flying connection can be made of two housings shielded as described above and shown in FIG. 8 as the shielded housings 180 and 181, respectively. The connectors in housings 180 and 181 will have male and female contacts respectively within their D-shaped shrouds. When making the flying connection between two shielded housings, it will also be noted that the spacers such as spacers 77 and 78 for each housing are removed to enable bring the faces of the two D connectors closer together and within about 0.025 inch. Only one front conductive gasket 74 of FIG. 2 need be used for the two housings, with one housing 80 being a male type of housing and the housing 181 being a female type housing.

In the above-described embodiment of the invention, the conductive housing is a four-part housing consisting primarily of members 70, 71, 72 and 73 with an insulation shroud around the connector pins. Portions of the housing can be subassembled at the factory and components 70, 72 and 73 can be permanently fixed together, or can be integral with one another. The displacement connector 20 and its assembled conductor 40 can be simply inserted into this subassembly of the three members. Thereafter, only the single side plate 71 need be added into place, as described above.

The novel structure described above has several meritorious features which should be emphasized. The first is that stamped members are used throughout for the shield, as contrasted to expensive cast bodies or the like. Other manufacturing processes can be used in place of stamping, if desired. Secondly, the assembly requires no screws but uses simple clamping keys which lock the device into an assembled condition and can be relatively easily removd for disassembly. Third, the novel compressible conductive gasket 60 provides an electrical connection between the cable and the shield and makes good connection despite wide tolerance variations in the manufacture of the parts. Fourth, the use of the serrations 80 and 81 for the side plates 70 and 71 provide strain relief since they press into the cable jacket 51 to securely hold the cable 40 relative to the connector 20 and relieve strain at the connection between the connector contacts and the cable.

Connectors such as connector 20 and cables such as cable 40 will come in various sizes, depending upon the number of conductors which are contained within the cable 40. With the present invention, many parts can be used without change for different sized connectors. Thus, the same end caps 72 and 73 and key structure can be used regardless of the connector size.

Referring next to FIGS. 9 to 14, the embodiment of the invention shown therein employs a metal shroud in place of the insulation shroud for the connector of the embodiment of FIGS. 1 to 8, and contains other improvements for making connection from the cable to the conductive housing and for permitting the mounting of the shielded housing in a variety of ways.

Figure 9:
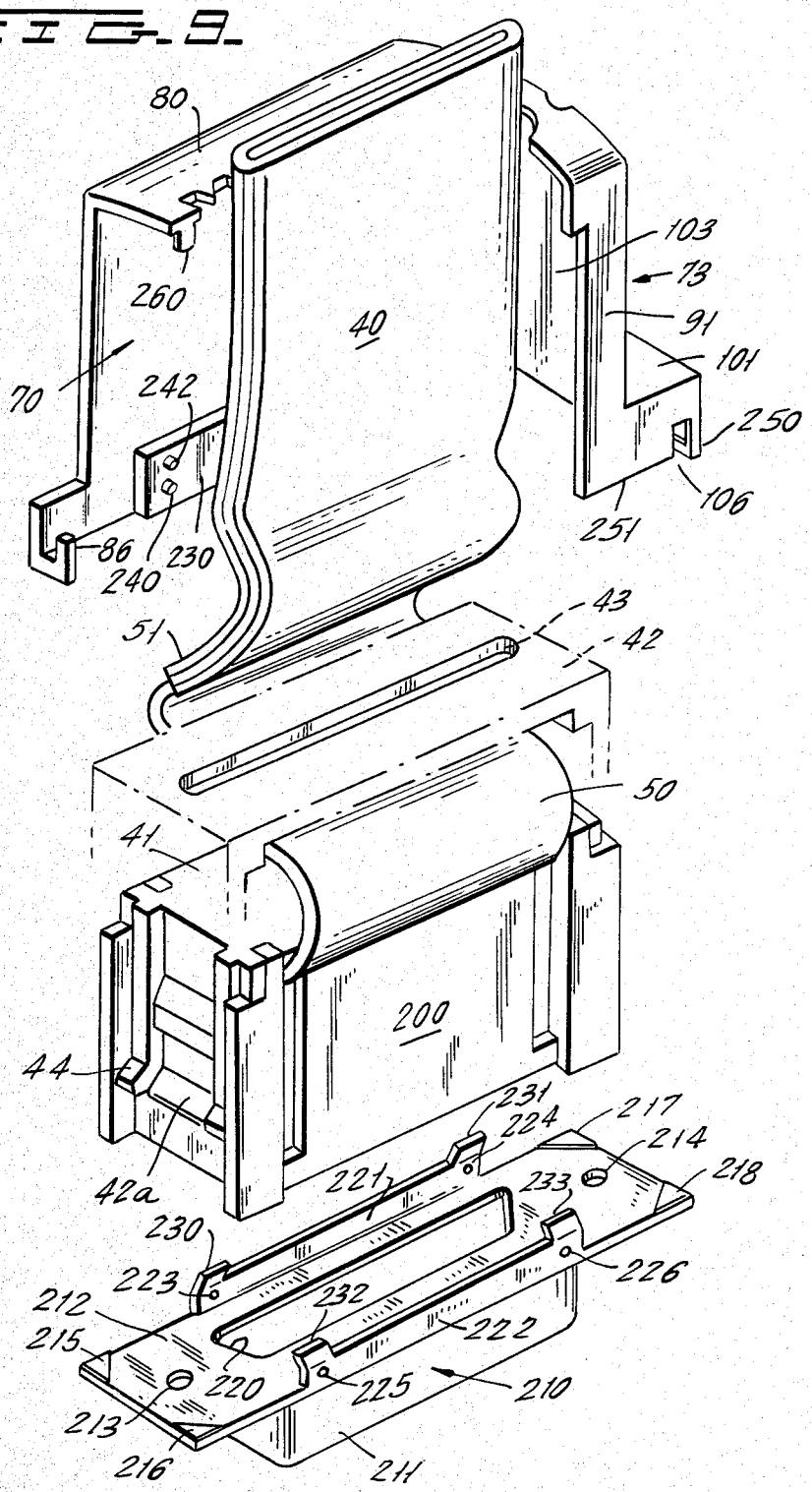
FIG. 9 is an exploded perspective view of a further embodiment of the invention.
Figure 10:
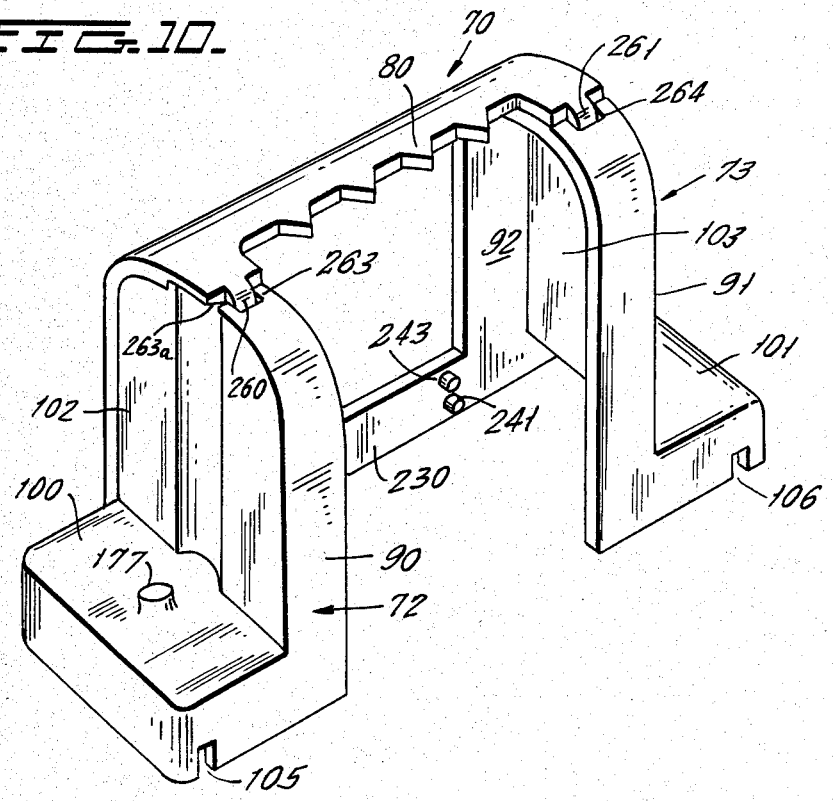
FIG. 10 is a perspective view of one side plate and the two end cups of the novel housing structure of FIG. 9.
Figure 11:
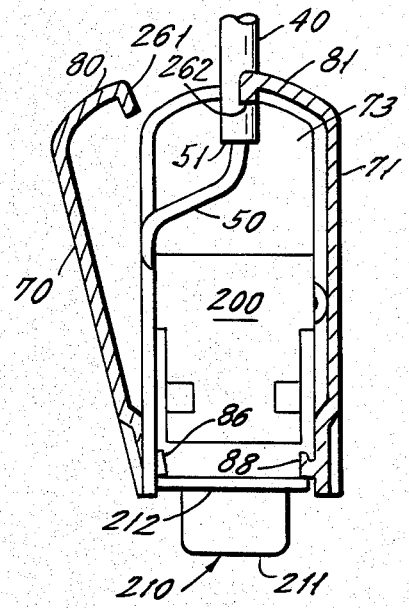
FIG. 11 is an end view partly in cross-section which schematically illustrates an assembled conductive housing with a connector and cable before the last side plate is snapped into the end caps to complete the enclosure.

In the embodiment of FIGS. 9 to 14, those components and elements which are similar to those of the embodiment of FIGS. 1 to 8 have been given the same identifying numerals. There are, however, a number of differences. The structure being shielded is the connector 200 (FIGS. 9 and 11). Connector 200 is generally similar to connector 20 of FIGS. 1 to 8 but differs in that it does not have insulation mounting flanges. In the case of a male connector, the insulation shroud is removed completely. In the case of a female connector, the insulation shroud surface is cut down in width and breadth, and covered with the metal can or shroud. The connector 200 is otherwise similar if not identical to the connector 20 shown, for example, in FIG. 2. Thus, there is a plain cover 41 and a stress-relief cover 42.

Figure 12:
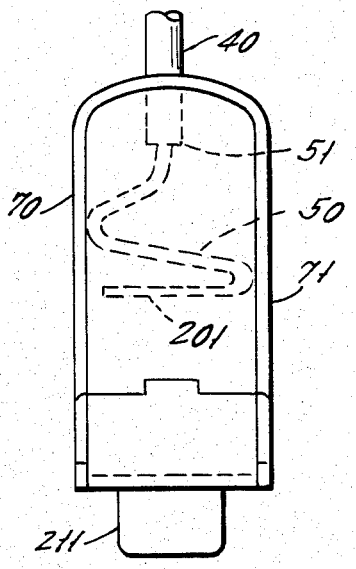
FIG. 12 schematically illustrates the path of the cable and the connection of the metal sheath of the cable to the interior of the conductive enclosure for the embodiment of FIGS. 9, 10 and 11.
Figure 14:
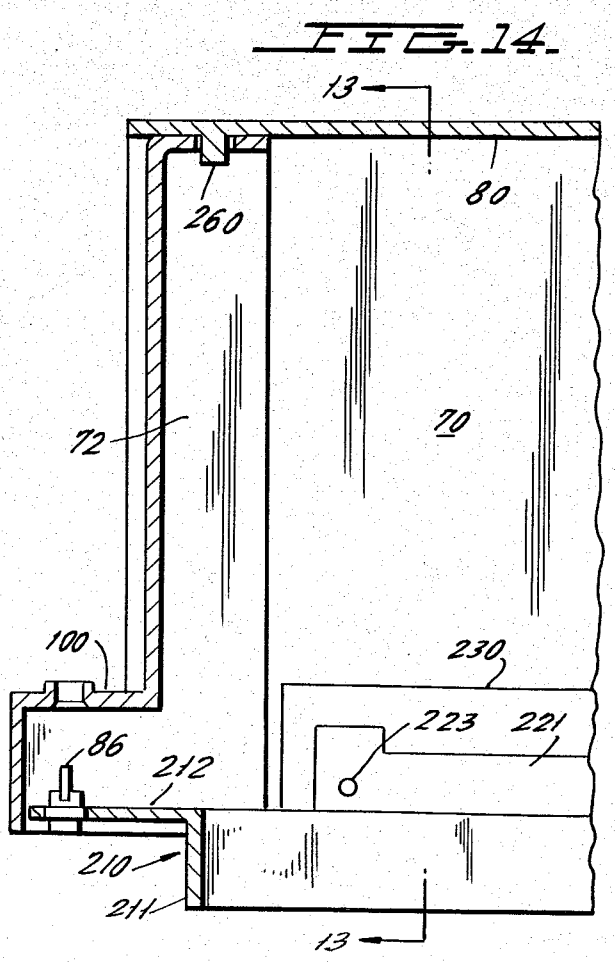
FIG. 14 is a cross-sectional view of FIG. 13 taken across the section line 14—14 in FIG. 13.

Connector contacts similar to those shown in FIGS. 1 to 8 pierce the portion 201 of cable shown in FIG. 12 and make contact with respective cable wires. The conductive shield 50 is removed from cable portion 201. Cable portion 201 is clamped between the plain cover 41 and the contacts which lie below the plain cover 41.

In threading the cable into the connector 200 of FIGS. 9 and 11, it will be noted that the conductive sheath 50 is left in place until the point at which the cable enters the area between the plain cover 31 and the exposed cable-piercing contact such as contacts 21 and 23 of FIG. 1. The cable is then trapped between the plain cover 41 and the stress-relief cover 42 as schematically shown in FIGS. 9 and 11 in such a manner that the cable path follows two loose loops so that, as shown in FIG. 12, the conductive sheath 50 at the loops will press against the walls of side plates 70 and 71 under the resilient force of the cable which is relatively self-supporting over a short length of cable. Thus, the loops make good electrical contact with the conductive enclosure. A wide degree of slack can be placed in the loops simply by adjusting the cable slack as desired before clamping down the stress-relief cover 43 and before latching closed the side plates 70 and 71.

It has been found that good electrical contact is made by looping the cable within the housing, as shown in FIGS. 9 through 12. This method of making contact permits wide tolerance variations in the manufacture of the stamped metal parts forming the housing.

The structure of the embodiment of FIGS. 9 to 14 employs a metal shroud in place of the insulation shroud 30 shown, for example, in FIGS. 1 and 2. Thus, a stamped metal shroud 210 of FIGS. 9 and 11 through 14 is provided, which includes a pin-shroud enclosure 211 and a metal flange 212. Flange 212 may have the mounting openings 213 and 214 (FIG. 9) which serve the purpose of the mounting openings in the ears 32 and 33 of connector 20 of FIGS. 1 and 2. Note that openings 213 and 214 align with respective openings including opening 177 and another in the end caps 72 and 73 of the metal enclosure structure.

The flange 212, as best shown in FIG. 9, is provided with breakaway corners 215, 216, 217 and 218 which are formed by stamped frangible lines which enable the corners to be broken off when it is desired to telescope the metal shroud 210 deeper into the other parts of the metal enclosure. Thus, while the breakaway flange corners are in place and the assembly is telescoped into the side plates 70 and 71 and end cups 72 and 73, the flange corners will seat against the bottom of the hinge hooks such as hinge hooks 86 and 88. This then defines the maximum penetration of the shroud 210 into the housing. By breaking off corners 215 to 218, the flange corners will clear the hinge hooks so that the shroud can telescope more deeply into the rectangular enclosure formed by plates 70 and 71 and end cups 72 and 73 to enable different kinds of mounting arrangements for the shielded connector.

The shroud 210 is provided with an opening 220 in the flange 212 to enable the contact pins from the connector to project through and down into the pin shroud enclosure 211. Also provided are upstanding sides 221 and 222 (FIGS. 9, 13 and 14) which may be integral with the flange 212. Sides 221 and 222 are provided with detent-receiving openings 223–224 and 225–226 as well as assembly guide ears 230–231 and 232–233, respectivly, for guiding the shroud into into the remainder of the conductive enclosure during assembly.

Side plates 70 and 71 have a modified construction from that shown for the embodiment of FIGS. 1 to 8 in that side plates 70 and 71 are provided with offsets 230 and 231. Each offset 230 and 231 contains at least one pair of detents, each of which is aligned with openings 223 to 226 in the shroud 210. Thus, side plate 70 is provided with lower detents 240 (FIGS. 9 and 13) and 241 (FIG. 10) and upper detents 242 (FIGS. 9 and 13) and 243 (FIG. 10). A similar set of detents is contained in offset portion 231 of side plate 71.

When assembling the conductive housing, the openings 223 and 225, for example, of shroud 210 can receive detent 230 and a corresponding detent in offset 231, respectively. This will then locate the shroud 210 in the position shown in FIGS. 13 and 14 so that the shroud is fixed in an extended position for making particular connections to panel connectors or other connectors in a flying connection, as is desired.

Figure 13:
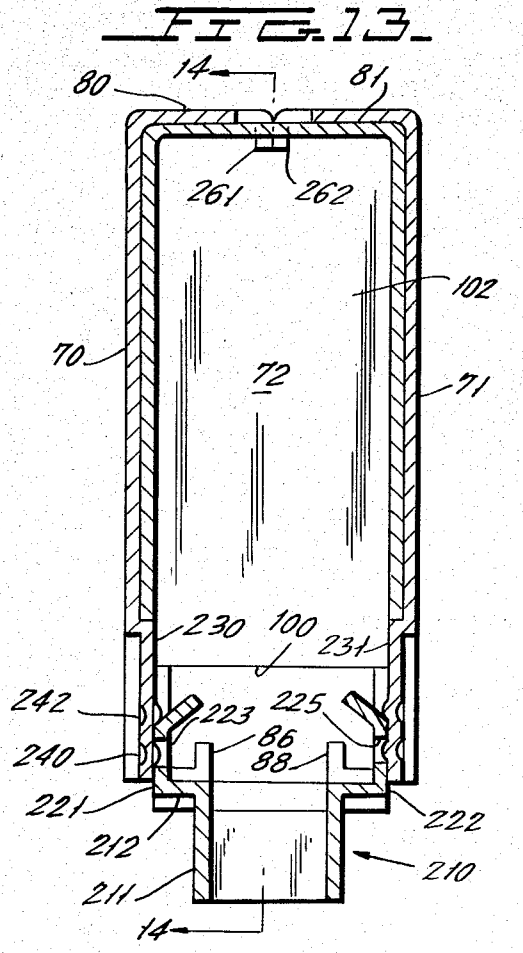
FIG. 13 is a cross-sectional view of the conductive enclosure of the embodiment of FIGS. 9 to 12 in the absence of the connector to illustrate the manner in which the enclosure is arranged.

If, however, a recessed position is desired for the shroud, the corners 216 to 218 are broken off so that the flange corners of flange 212 will clear the pivotal hooks such as hooks 86 and 88 of FIG. 13. The shroud can then be fixed deeper into the housing, for example, by an additional $\frac{1}{8}$ inch, until the openings, such as openings 223 and 225 of the shroud receive the upper set of detents, such as detent 242 and a corresponding detent in offset 231, respectively (FIG. 13). The connector will now be arranged for connection to panels or other connectors which require the recessed positioning of the shroud.

As shown in FIG. 9, the outer edge 250 at the bottom of cup 73 is slightly deeper than the side edge 251. When using this structure, the edge 250 covers the confronting edge of the flange 212, thus improving the conductive shrouding of the connector 200 and the pins which extend therefrom within the pin shroud enclosure 211.

A further important feature in the embodiment of FIGS. 9 to 14 is the manner in which the side plates 70 and 71 are connected to the end cups 72 and 73. Thus, the key structure shown in the embodiments of FIGS. 1 to 8 is replaced by latching tabs, such as tabs 260 and 261 in side plate 70 and similar tabs including tab 262 (FIG. 13) for the side plate 71. Centrally located slots, such as the slots 263 and 264, are then formed in the tops of side cups 72 and 73, respectively, for receiving tabs, such as tabs 260, 261 and 262 for locking together the rectangular enclosure formed by the side plates and end cups.

In operation, the side plates 70 and 71 are first hooked into slots, such as slots 105 and 106 in the bottoms of the end cups and are then pressed pivotally toward the end cups. The locking tabs of the side plates will thus cam over the tops of the end cups and eventually snap into and seat in openings 263 and 264 to lock the assembly together. The assembly is shown partly assembled in FIG. 11 where the side plate 70 remains to be pressed into place.

To assist is opening the asembly, the locking tabs of FIG. 10 can have chamfered sections, such as chamfer 263*a* shown in FIG. 10.

While the side plates 70 and 71 and end cups 72 and 73 in the embodiment of FIGS. 9 to 14 can be separate parts, it is possible to sub-assemble side plate 70 with end cups 72 and 73 so that they are relatively permanently joined. The assembly is then completed after the insertion of connector 200 by snapping the side plate 71 into position in the manner previously described.

In the above embodiments, the cable 40 was shown as having an end terminating at the connector, with the conductor enclosure enclosing the connector and preventing EMI from the connector. Other cable connections are possible. For example, where a connection is to be made at an intermediate portion along the length of the cable for a so-called "daisy-chain" connection, the present invention can still enclose the connection with a metallic enclosure to prevent EMI. Such an arrangement is shown in FIG. 15 which shows the daisy-chain type connection for a connector of the type shown in FIG. 9.

Figure 15:
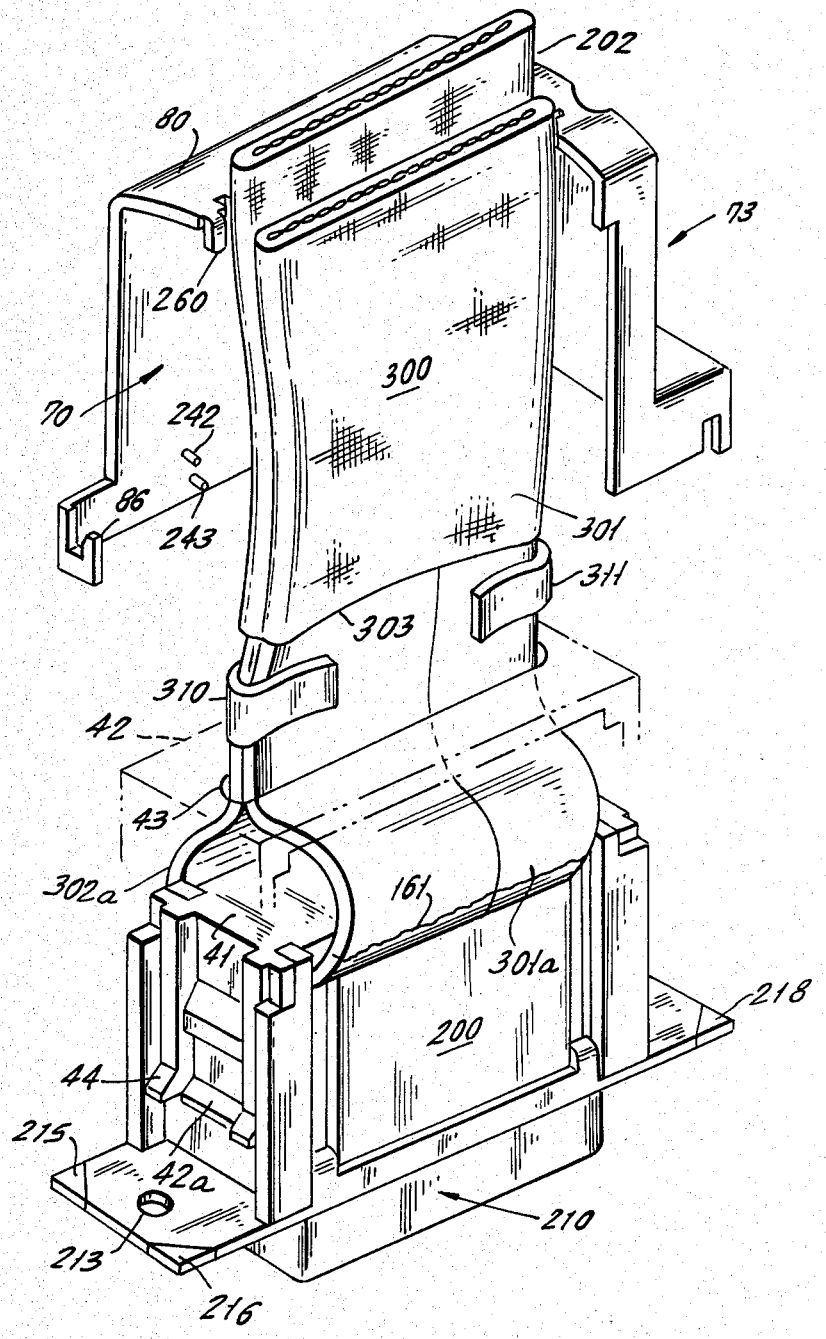
FIG. 15 is an exploded perspective view of the invention with the cable connected in the daisy-chain connection fashion.

Referring to FIG. 15, the cable 300 is a continuous length of cable having an incoming section 301 and outgoing section 302. The cable insulation jacket 303 is removed in the continuous portion of the cable 300 which enters the connector through slot 43 in strain relief cover 42. The cable shield 161 is removed from the portion of cable 300 which passes under cover 41 and is pressed into contact with the contacts of the conductor. Both of sections 301 and 302 are looped outwardly at the bottom sections 301*a* and 302*a* so that the exposed conductive sheath at these regions is pressed outwardly and into electrical contact with the interior of side plates 71 and 70, respectively, when the plates are fixed in place over the connector.

To prevent an air gap path from the connector interior through the possibly spaced conductor sections 301 and 302, two metal spring clips 310 and 311 press together the exposed shields of sections 301 and 302. This conductively seals any gap which could have been formed to prevent accidental leakage of radiation from the enclosure. When the cable 300 is sufficiently narrow, only one clip need be used. The clips 310 and 311 should have smooth interior surfaces so that they can be applied without tearing the cable shield.

Although the present invention has been described is connection with preferred embodiments thereof, many variations and modifications will now become apparent to those skilled in the art. It is preferred, therefore, that the present invention be limited not by the specific disclosure herein, but only by the appended claims.

What is claimed is:

1. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; the multiconductor cable connector being loosely bent within said hollow interior region and pressed by the force of its inherent resiliency to flexibly connect the outer surface of the conductive sheet into electrical engagement with at least a portion of the interior of said generally rectangular configuration enclosure formed by said first and second end cups and said first and second side plates.

2. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; the outer surface of the conductive sheath of said multiconductor cable being flexibly connected into electrical engagement with at least a portion of the interior of said generally rectangular configuration enclosure formed by said first and second end cups and said first and second side plates, the enclosure further including a flat metal gasket member extending across said second end of said connector; said gasket member having a central opening therein for exposing said plurality of contacts.

3. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; the outer surface of the conductive sheath of said multiconductor cable being flexibly connected into electrical engagement with at least a portion of the interior of said generally rectangular configuration enclosure formed by said first and second end cups and said first and second side plates; the enclosure further including first and second bifurcated key members, the legs of which extend through aligned pairs of slots in said first and second end cups and in said first and second side plates to clamp together said end cups and said side plates to form said rectangular enclosure.

4. The enclosure of claim 3, wherein said bifurcated key members contain opposing inclined camming surfaces for forcing said first and second side plates toward one another as said key members are pressed into said aligned pair of slots.

5. The enclosure of claim 4, wherein said bifurcated key members have locking projections on at least one of their legs for latching under said slots when said key members are fully inserted in their said respective slots.

6. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; the outer surface of the conductive sheath of said multiconductor cable being flexibly connected into electrical engagement with at least a portion of the interior of said generally rectangular configuration enclosure formed by said first and second end cups and said first and second side plates; the ends of said first and second side plates containing respective inwardly bent flaps adjacent said first end of said connector; the edges of said inwardly bent flaps being serrated and mechanically engaging opposite surfaces of said cable connector when said shielding enclosure is completed.

7. The enclosure of claim 6, wherein said first and second end cups telescope into the space between said first and second side plates.

8. The enclosure of claim 6 which further includes a compressible conductive member disposed within said hollow region and compressed into mechanical and electrical engagement between said conductive sheath of said multiconductor cable connector and the interior of said generally rectangular enclosure.

9. The enclosure of claim 8, wherein said compressible conductive member forms an O-ring which surrounds said cable connector and wherein said enclosure includes an annular surface on the interior of said rectangular enclosure, said compressible conductive member engaging said annular surface.

10. The enclosure of claim 8, wherein said compressible conductive member is a wire woven O-ring.

11. The enclosure of claim 8, wherein said compressible conductive member consists of a portion of the material of said conductive shield which is expanded in volume to be compressible against the interior surface of said generally rectangular configuration enclosure.

12. The enclosure of claim 6, wherein said side plates and said end cups are stamped from sheet metal.

13. The enclosure of claim 6, wherein said first and second end cups are separate identical members and said first and second side plates are separate identical members.

14. The enclosure of claim 6, wherein said first end cup and said first and second side plates are integrally joined to one another.

15. The enclosure of claim 6, wherein said connector is an insulation displacement connector.

16. The enclosure of claim 6, wherein at least said second side plate contains first and second hooks at its opposite sides adjacent said second end of said conductor; said first and second end cups having hook receiving slots for receiving said first and second hooks, respectively, thereby to secure one end of said second side plate to said first and second end cups.

17. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; a continuous portion of said cable being doubled and said doubled length being contained within said enclosure with the base of said doubled length connected to said plurality of contacts; the outer surface of the conductive sheath of said multiconductor cable being flexibly connected into electrical engagement with at least a portion of the interior of said generally rectangular configuration enclosure formed by said first and second end cups and said first and second side plates.

18. The enclosure of claim 17 which further includes spring clip means for pressing together the shield on said doubled length of cable which is within said enclosure.

19. The enclosure of claim 18, wherein said shroud telescopes into said one end of said rectangular enclosure.

20. The enclosure of claim 19, wherein the ends of said first and second side plates contain respective inwardly bent flaps adjacent said first end of said connector; the edges of said inwardly bent flaps being serrated and mechanically engaging opposite surfaces of said cable when said shielding enclosure is completed; the ends of said inwardly bent flaps containing projecting tabs which engage respective slots in said end cups to secure together said first and second side plates and said first and second end cups.

21. The enclosure of claim 20, wherein at least said second side plate contains first and second hooks at its opposite sides adjacent said second end of said conductor; said first and second end cups having hook receiving slots for receiving said first and second hooks, respectively, thereby to secure one end of said second side plate to said end cups.

22. A conductive shielding enclosure for a generally flattened rectangular multiconductor cable connector having an outer conductive sheath; said connector having a generally rectangular configuration which has generally flat parallel faces which are joined at their edges by first and second generally parallel sides which has first and second ends; said connector having a flat shielded multiconductor cable extending from said first end thereof; said connector having a plurality of contacts; each of said plurality of contacts connected to a respective one of the conductors of said multiconductor cable; said shielding enclosure comprising first and second conductive end cups which are adjacent to and which extend across said first and second sides respectively of said connector and first and second conductive side plates which are adjacent to and extend across said first and second faces respectively of said conductors respectively; said first and second end cups and said first and second side plates extending beyond said one end of said connector; means connecting said first and second side plates and said first and second end cups together to form a rectangular enclosure which defines a hollow interior region surrounding said cable connector and extending from said one end of said connector; the multiconductor cable connector being loosely bent within said hollow interior region and pressed by the force of its inherent resiliency to flexibly connect the outer surface of the conductive sheet into electrical engagement with at least a portion of the interior of said generally rectangular configuration enclosure formed by said first and second end cups and said first and second side plates, said enclosure further including a conductive shroud mechanically and electrically connected to said enclosure adjacent to said second end of said connector; said second end of said connector having contact pins extending therefrom; said shroud enclosing said contact pins, a conductive flange extending across one end of said shroud; said conductive flange extending across said second end of said connector and around said contact pins and connected to the end of said rectangular enclosure, cooperating detent means being fixed to said shroud and said rectangular enclosure for fixing the position of said shroud releative to said end of said rectangular enclosure between and extended in a recessed position.

* * * * *